US011355081B1

(12) United States Patent
Tian

(10) Patent No.: US 11,355,081 B1
(45) Date of Patent: Jun. 7, 2022

(54) GOA CIRCUIT, DISPLAY PANEL AND DISPLAY DEVICE

(71) Applicant: WUHAN CHINA STAR OPTOELECTRONICS TECHNOLOGY CO., LTD., Wuhan (CN)

(72) Inventor: Chao Tian, Wuhan (CN)

( * ) Notice: Subject to any disclaimer, the term of this patent is extended or adjusted under 35 U.S.C. 154(b) by 39 days.

(21) Appl. No.: 17/261,014

(22) PCT Filed: Jun. 30, 2020

(86) PCT No.: PCT/CN2020/099147

§ 371 (c)(1),
(2) Date: Jan. 17, 2021

(87) PCT Pub. No.: WO2021/248584

PCT Pub. Date: Dec. 16, 2021

(30) Foreign Application Priority Data

Jun. 9, 2020 (CN) ..... 202010515879.9

(51) Int. Cl.
*G09G 3/36* (2006.01)

(52) U.S. Cl.
CPC ..... *G09G 3/3677* (2013.01); *G09G 2310/08* (2013.01)

(58) Field of Classification Search
CPC ..... G09G 3/3677; G09G 2310/08
See application file for complete search history.

(56) References Cited

U.S. PATENT DOCUMENTS

| | | | |
|---|---|---|---|
| 2007/0263763 | A1 | 11/2007 | Moon |
| 2010/0260312 | A1 | 10/2010 | Tsai et al. |
| 2013/0169609 | A1 | 7/2013 | Son et al. |
| 2014/0085176 | A1 | 3/2014 | Kang |
| 2014/0146026 | A1 | 5/2014 | Yu |
| 2015/0280704 | A1 | 10/2015 | Wu et al. |

(Continued)

FOREIGN PATENT DOCUMENTS

| | | | |
|---|---|---|---|
| CN | 101364446 | A | 2/2009 |
| CN | 103187040 | A | 7/2013 |

(Continued)

*Primary Examiner* — David Tung

(57) ABSTRACT

A gate driver on array (GOA) circuit, a display panel and a display device are provided. The GOA circuit includes m cascaded GOA units. An $n^{th}$-stage GOA unit includes a second feedback module. The second feedback module, electrically connected to the second node of the $n^{th}$-stage GOA unit, a first node of the $(n-1)^{th}$-stage GOA unit, the clock signal of the $(n+1)^{th}$-stage GOA unit, a gate driving signal of the $n^{th}$-stage GOA unit and the constant low voltage signal, to pull down voltage applied on a second node of the $n^{th}$-stage GOA unit. The one-way feedback could achieve the linear design more easily, raise the circuit stability, and thus the GOA circuit could be integrated in the display panel more easily to achieve the design of placing the GOA circuit in the active area.

10 Claims, 5 Drawing Sheets

(56) References Cited

U.S. PATENT DOCUMENTS

| | | | | |
|---|---|---|---|---|
| 2016/0365052 | A1 | 12/2016 | Park et al. | |
| 2017/0124975 | A1* | 5/2017 | Xiao | G09G 3/3677 |
| 2017/0186352 | A1 | 6/2017 | Lin et al. | |
| 2017/0193944 | A1* | 7/2017 | Xiao | G11C 19/28 |
| 2018/0046308 | A1* | 2/2018 | Xiao | G09G 3/20 |
| 2020/0226993 | A1 | 7/2020 | Zhang et al. | |
| 2020/0410948 | A1 | 12/2020 | Dai | |

FOREIGN PATENT DOCUMENTS

| | | | |
|---|---|---|---|
| CN | 103208263 | A | 7/2013 |
| CN | 103295511 | A | 9/2013 |
| CN | 103500550 | A | 1/2014 |
| CN | 105513550 | A | 4/2016 |
| CN | 105702223 | A | 6/2016 |
| CN | 105786250 | A | 7/2016 |
| CN | 107403602 | A | 11/2017 |
| CN | 109036304 | A | 12/2018 |
| CN | 109326261 | A | 2/2019 |
| CN | 109712552 | A | 5/2019 |
| GB | 2412798 | B | 3/2007 |

* cited by examiner

GOA CIRCUIT, DISPLAY PANEL AND DISPLAY DEVICE

CROSS REFERENCE

This application is a US national phase application based upon an International Application No. PCT/CN2020/099147, filed on Jun. 30, 2020, which claims the priority of Chinese Patent Application No. 202010515879.9, entitled "GOA CIRCUIT, DISPLAY PANEL AND DISPLAY DEVICE", filed on Jun. 9, 2020, the disclosure of which is incorporated herein by reference in its entirety.

FIELD OF THE INVENTION

The present invention relates to a display technique, and more particularly, to a GOA circuit, a display panel and a display device.

BACKGROUND

A Liquid crystal display (LCD) device is widely used in all kinds of electronic products, such as LCD TV, mobile phone, personal digital assistant (PDA), digital camera, computer or laptop. Furthermore, the gate driver on array (GOA) circuit is an important component of the LCD device.

The GOA circuit is a technique, which uses the conventional LCD array manufacturing process to form the gate driver circuit on the array substrate for sequentially scanning each gate lines of the LCD.

The GOA circuit has two basic functions: 1. Output the gate driving signals to drive the gate lines of the panel to turn on the thin film transistors (TFTs) to charge the pixels in the display area; 2. Work as a shift register. When a gate driving signal is completely outputted, the GOA circuit outputs a next gate driving signal under the control of the clock signal and sequentially passes and the gate driving signal in order. The GOA technique could reduce the bonding process for external integrated circuits, raises the productivity and reduces the manufacturing cost. In addition, the GOA technique is better for the display device having a narrow side frame.

Conventionally, the GOA circuit is placed on the two sides of the panel. However, as the development progress of the full-screen cell phone, the demand for the side frame becomes stricter. Furthermore, for the vehicle applications, the appearance of the panel is various and becomes more complicated. The conventional GOA cannot meet the higher demand and the design of the GOA circuit comes to a bottleneck: the width of the GOA circuit cannot be shrunk and thus the side frame of the panel cannot be smaller.

In order to reduce the size of the panel, some GOA circuits have special design. That is, the GOA circuit is placed in the active area to try to achieve a no-side-frame design. However, this design has a better requirement for the GOA circuit because this GOA circuit has a complicated inner feedback mechanism and thus is not easy to be integrated inside the panel.

Therefore, a novel GOA circuit is required to ensure the circuit stability and also to be easy to be placed in the active region.

SUMMARY

One objective of an embodiment of the present invention is to provide a GOA circuit, a display panel and a display device to solve the above-mentioned issues. The GOA circuit introduces the second feedback module on the basis of the conventional GOA circuit. The second feedback module controls the node P of the current stage according to the output of the current stage and the node Q of the previous stage. This achieves the one-way feedback from the node P to the node Q, avoids the competition between inner nodes P/Q and raises the circuit stability. Furthermore, it reduces the circuit complexity. The one-way feedback could achieve the linear design more easily and thus the GOA circuit could be integrated in the display panel more easily to achieve the no-side-frame design. Thus, this could solve the issues of the conventional GOA circuit, which is difficult to be integrated because the inner feedback mechanism is complicated.

According to an embodiment of the present invention, a gate driver on array (GOA) circuit is disclosed. The GOA circuit comprises m cascaded GOA units. An $n^{th}$-stage GOA unit of comprises: an input module, electrically connected to a clock signal of an $(n+1)^{th}$-stage GOA unit, a gate driving signal of an $(n-1)^{th}$-stage GOA unit, and a first node of the $n^{th}$-stage GOA unit; an output pull-up module, electrically connected to the first node of the $n^{th}$-stage GOA unit, a constant high voltage signal and a clock signal of the $n^{th}$-stage GOA unit; a pull-down control module, electrically connected to the constant high voltage signal, the clock signal of the $(n+1)^{th}$-stage GOA unit and a second node of the $n^{th}$-stage GOA unit; an output pull-down module, electrically connected to the second node of the $n^{th}$-stage GOA unit and a constant low voltage signal; a first feedback module, electrically connected to the first node and the second node of the $n^{th}$-stage GOA unit, the clock signal of the $n^{th}$-stage GOA unit and the constant low voltage signal; a second feedback module, electrically connected to the second node of the $n^{th}$-stage GOA unit, a first node of the $(n-1)^{th}$-stage GOA unit, the clock signal of the $(n+1)^{th}$-stage GOA unit, a gate driving signal of the $n^{th}$-stage GOA unit and the constant low voltage signal; and a FM function module, electrically connected to the constant low voltage signal and a global signal, where m and n are both integers and $m \geq n \geq 1$.

Furthermore, the input module comprises a first thin film transistor (TFT), having a gate receiving the clock signal of the $(n+1)^{th}$-stage GOA unit, a source receiving the gate driving signal of the $(n-1)^{th}$-stage GOA unit, and a drain electrically connected to the first node of the $n^{th}$-stage GOA unit.

Furthermore, the second feedback module comprises: a second TFT, having a gate electrically connected to the first node of the $(n-1)^{th}$-stage GOA unit, a source receiving the clock signal of the $(n+1)^{th}$-stage GOA unit, and a drain electrically connected to the second node of the $n^{th}$-stage GOA unit; and a third TFT, having a gate receiving the gate driving signal of the $n^{th}$-stage GOA unit, a source receiving the constant low voltage signal, and a drain electrically connected to the second node of the $n^{th}$-stage GOA unit.

Furthermore, the first feedback module comprises: a fourth TFT, having a gate receiving the clock signal of the $n^{th}$-stage GOA unit, a source, and a drain electrically connected to the first node of the $n^{th}$-stage GOA unit; and a fifth TFT, having a gate electrically connected to second node of the $n^{th}$-stage GOA unit, a source receiving the constant low voltage signal, and a drain electrically connected to the source of the fourth TFT.

Furthermore, the output pull-up module comprises: a sixth TFT, having a gate receiving the constant high voltage signal, a source electrically connected to the first node of the $n^{th}$-stage GOA unit, and a drain; and an eighth TFT, having a gate electrically connected to the drain of the sixth TFT and a source receiving the clock signal of the $n^{th}$-stage GOA unit.

Furthermore, the pull-down control module comprises: a seventh TFT, having a gate receiving the clock signal of the $(n+1)^{th}$-stage GOA unit, a source receiving the constant low voltage signal, and a drain electrically connected to the second node of the $n^{th}$-stage GOA unit.

Furthermore, the output pull-down module comprises:

a ninth TFT, having a gate electrically connected to the second node of the $n^{th}$-stage GOA unit, and a source receiving the constant low voltage signal.

Furthermore, the FM function module comprises: a tenth TFT, having a gate receiving the global signal, and a source receiving the constant low voltage signal.

According to an embodiment of the present invention, a display panel is disclosed. The display panel comprises the above-mentioned GOA circuit.

According to an embodiment of the present invention, a display device is disclosed. The display device comprises the above-mentioned display panel.

The GOA circuit according to an embodiment of the present invention introduces the second feedback module. The second feedback module controls the node P of the current stage according to the output of the current stage and the node Q of the previous stage. This avoids the competition between inner nodes P/Q and raises the stability of the node P. Furthermore, the present invention changes the two-way feedback between the nodes P and Q of the conventional GOA circuit into a one-way feedback from the node P to the node Q. This reduces the feedback complexity between the nodes P and Q in the circuit and thus reduces the circuit complexity. The one-way feedback could achieve the linear design more easily, raise the circuit stability, and thus the GOA circuit could be integrated in the display panel more easily to achieve the design of placing the GOA circuit in the active area.

BRIEF DESCRIPTION OF THE DRAWINGS

To describe the technical solutions in the embodiments of this application more clearly, the following briefly introduces the accompanying drawings required for describing the embodiments. Apparently, the accompanying drawings in the following description show merely some embodiments of this application, and a person of ordinary skill in the art may still derive other drawings from these accompanying drawings without creative efforts.

DETAILED DESCRIPTION OF PREFERRED EMBODIMENTS

Figure 1:
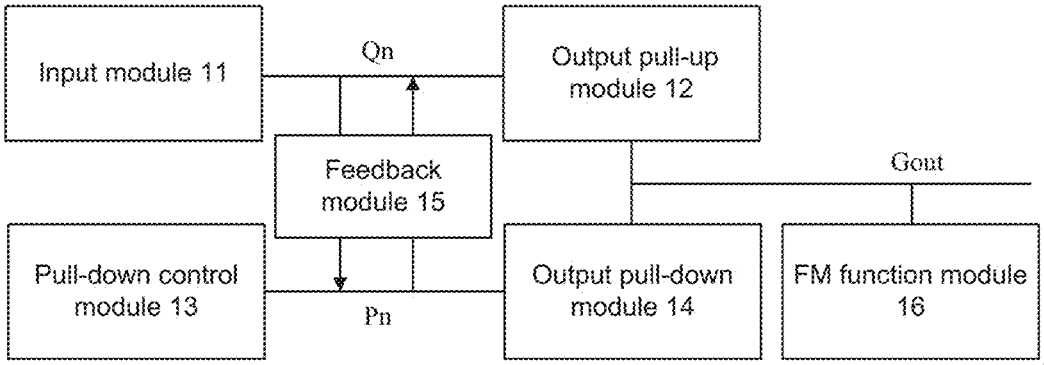
FIG. 1 is a functional block diagram of a conventional GOA circuit.

The invention is described below in detail with reference to the accompanying drawings, wherein like reference numerals are used to identify like elements illustrated in one or more of the figures thereof, and in which exemplary embodiments of the invention are shown. This invention may, however, be embodied in many different forms and should not be construed as limited to the particular embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

In the description of this specification, the description of the terms "one embodiment", "some embodiments", "examples", "specific examples", or "some examples", and the like, means to refer to the specific feature, structure, material or characteristic described in connection with the embodiments or examples being included in at least one embodiment or example of the present disclosure. In the present specification, the term of the above schematic representation is not necessary for the same embodiment or example. Furthermore, the specific feature, structure, material, or characteristic described may be in combination in a suitable manner in any one or more of the embodiments or examples. In addition, it will be apparent to those skilled in the art that different embodiments or examples described in this specification, as well as features of different embodiments or examples, may be combined without contradictory circumstances.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In addition, the term "first", "second" are for illustrative purposes only and are not to be construed as indicating or imposing a relative importance or implicitly indicating the number of technical features indicated. Thus, a feature that limited by "first", "second" may expressly or implicitly include at least one of the features. In the description of the present disclosure, the meaning of "plural" is two or more, unless otherwise specifically defined.

Figure 2:
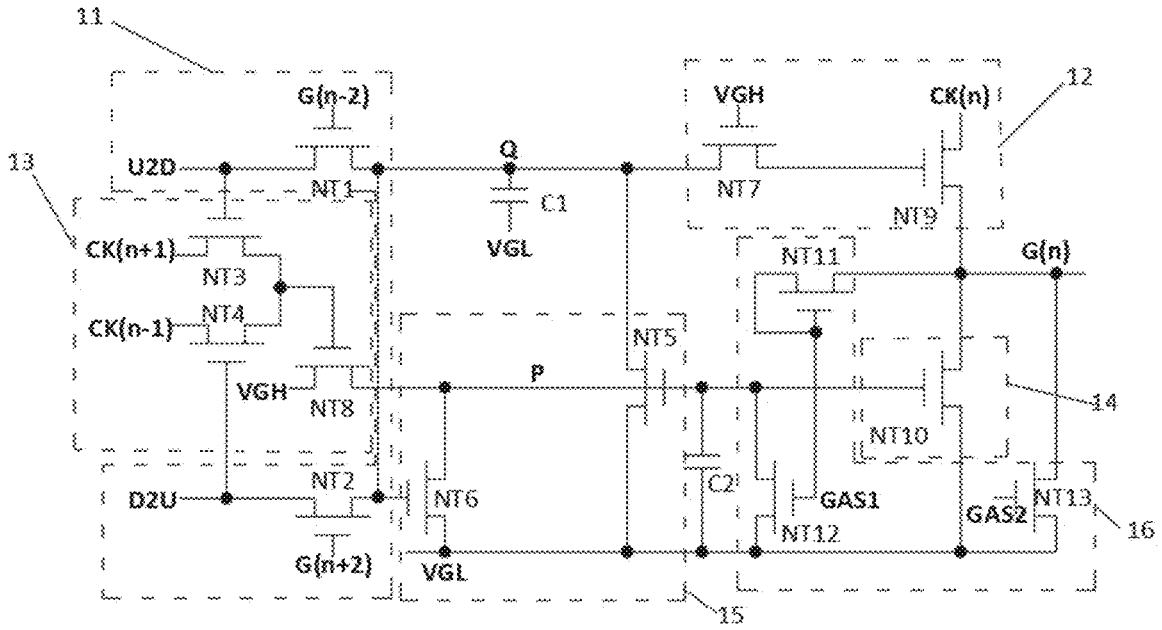
FIG. 2 is a diagram of a structure of the conventional GOA circuit.

Please refer to FIG. 1. FIG. 1 is a functional block diagram of a conventional GOA circuit. FIG. 2 is a diagram of a structure of the conventional GOA circuit. As shown in FIG. 1 and FIG. 2, the GOA circuit comprises m cascaded GOA units. The $n^{th}$-stage GOA unit of comprises: an input module 11, an output pull-up module 12, a pull-down control module 13, an output pull-down module 14, a feedback module 15, an FM function module 16, a first capacitor C1 and a second capacitor C2. Here, m and n are both integers and $m \geq n \geq 1$. The feedback module is a two-way feedback between the nodes P and Q.

The input module 11 controls the GOA circuit to perform a forward scan or a backward scan according to the forward scan control signal U2D or a backward scan control signal D2U. The input module 11 comprises a first thin film transistor (TFT) NT1 and a second TFT NT2. The gate of the first TFT NT1 is connected to the gate driving signal G(n−2) of the $(n-2)^{th}$ stage GOA unit. The source of the first TFT NT1 receives the forward scan control signal U2D. The drain of the first TFT NT1 is connected to the drain of the second TFT NT2, the feedback module 15 and the first node Q. The source of the second TFT NT2 receives the backward scan control signal D2U. The gate of the second TFT NT2 is connected to the gate driving signal G(n+2) of the $(n+2)^{th}$-stage GOA unit.

The pull-down control module 13 controls the current-stage ($n^{th}$-stage) GOA unit according to the $(n+1)^{th}$-stage clock signal CK(n+1) and the $(n-1)^{th}$-stage clock signal CK(n−1) to output a low voltage gate driving signal in the non-working phase. The pull-down control module 13 comprises the third TFT NT3, the fourth TFT NT4 and the eighth TFT NT8. The gate of the third TFT NT3 is connected to the source fo the first TFT NT1. The source of the third TFT NT3 receives the $(n+1)^{th}$-stage clock signal CK(n+1). The drain of the third TFT NT3 is connected to the drain of the fourth TFT NT4 and the gate of the eighth TFT NT8. The gate of the fourth TFT NT4 is connected to the source of the second TFT NT2. The source of the fourth TFT NT4 receives the $(n-1)^{th}$-stage clock signal CK(n−1). The source of the eighth TFT NT8 receives the constant high voltage signal VGH. The drain of the eighth TFT NT8 is connected to the second node P.

The output pull-up module 12 pulls up the voltage level of the node Q and outputs the current-stage gate driving signal according to the current-stage clock signal CK(n). The output pull-up module 12 comprises the seventh TFT NT7 and the ninth TFT NT9. The gate of the seventh TFT NT7 receives the constant high voltage signal VGH. The source of the seventh TFT NT7 is connected to the first node Q. The drain of the seventh TFT NT7 is connected to the gate of ninth TFT NT9. The source of the gate of ninth TFT NT9 receives the current-stage clock signal CK(n).

The output pull-down module 14 pulls down the voltage level of the current-stage gate driving signal G(n). The output pull-down module 14 comprises a tenth TFT NT10. The gate of the tenth TFT NT10 is connected to the second node P. The source of the tenth TFT NT10 receives the constant low voltage signal VGL. The drain of the tenth TFT NT10 is connected to the drain of the ninth TFT NT9.

The feedback module 15 realizes the two-way feedback between the nodes P and Q and is used to pull down the voltage levels of the first node Q and the second node P. The feedback module 15 comprises the fifth TFT NT5 and the sixth TFT NT6. The gate of the fifth TFT NT5 is connected to the second node P. The drain of the fifth TFT NT5 is connected to the first node Q. The source the fifth TFT NT5 receives the constant low voltage signal VGL. The gate of the sixth TFT NT6 is connected to the drain of the second TFT NT2. The source of the sixth TFT NT6 receives the constant low voltage signal VGL. The drain of the sixth TFT NT6 is connected to the second node P.

The FM function module 16 controls the voltage level of the gate driving signal when the display panel is in different working states according to the global signal. The FM function module 16 comprises the eleventh TFT NT11, the twelfth TFT NT12 and thirteenth TFT NT13. The gate and the source of the eleventh TFT NT11 are connected. The gate of the eleventh TFT NT11 and the gate of the twelfth TFT NT12 both receive the first global signal GAS1. The source of the twelfth TFT NT12 receives the constant low voltage signal VGL. The drain of the twelfth TFT NT12 is connected to the second node. The drain of the eleventh TFT NT11 is connected to the drain of the ninth TFT NT9, the drain of the tenth TFT NT10 and the drain of the thirteenth TFT NT13. The gate of the thirteenth TFT NT13 receives the second global signal GAS2. The source of the thirteenth TFT NT13 receives the constant low voltage signal VGL. The FM function module 16 pulls down the voltage level of the current-stage gate driving signal G(n) according to the second global signal GAS2 when the display panel is in the second working state and controls the current-stage GOA unit to output the high-voltage gate driving signal according to the first global signal GAS1 when the display panel is in the first working state. The first working state is a black screen working period or an abnormal shut-down state. It could be understood that the first global signal GAS1 corresponds to a high voltage level when the display panel is in the first working state. At this time, all GOA units output high-voltage-level gate driving signal. The second working state is a display touch working period. At this time, the second global signal GAS corresponds to a high voltage level.

One end of the first capacitor C1 is connected to the first node Q and another end of the first capacitor C1 receives the constant low voltage signal VGL. One end of the second capacitor C2 is connected to the second node P and another end of the second capacitor C2 receives the constant low voltage signal VGL.

When the display panel is in the forward scan state, the signal U2D corresponds to the high voltage level and the signal D2U corresponds to the low voltage level. At this time, the GOA circuit scans line by line from the top to the bottom. In contrast, when the display panel is in the backward scan state, the signal D2U corresponds to the high voltage level and the signal U2D corresponds to the low voltage level. At this time, the GOA circuit scans line by line from the bottom to the top.

As shown in FIG. 2, in the normal condition, the voltage levels of the signal VGL and the signal D2U are the same. In the reloading screen (such as dot inversion screen), the display area is connected to the signal VGL through the TFT NT10 and thus the signal VGL is affected the most by the display area due to the coupling effect. Therefore, compared with the signal D2U, the signal VGL has a larger interference. Although the signals VGL and D2U theoretically have the same voltage level, the signal VGL may have an instant voltage level higher than that of the signal D2U due to the coupling effect. Thus, the gate driving signal G(n+2) may not be pulled down. However, the gate of the TFT NT2 of the next-stage GOA unit receives the gate driving signal G(n+2) thus the TFT NT2 may be instantly turned on. If the TFT N2 is turned on, then the node Q may be pulled down from a high voltage level and cannot maintain its high voltage level. In this way, the normal stage-to-stage signal transfer function cannot work and makes the GOA circuit not working.

Figure 3:
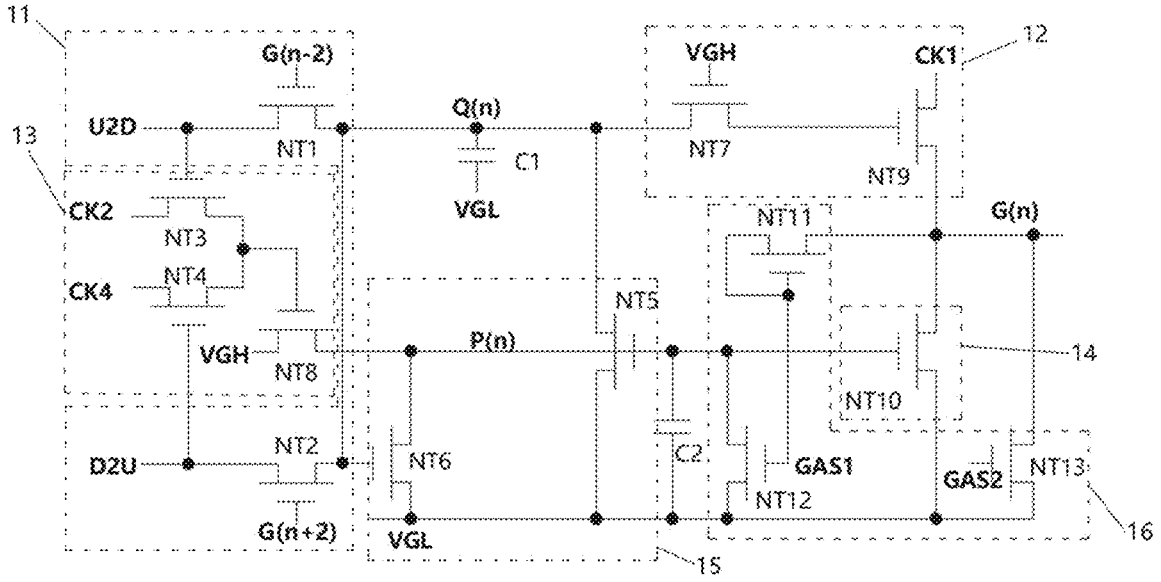
FIG. 3 is a diagram of a basic unit in the smallest repeating unit in the conventional GOA circuit.
Figure 4:
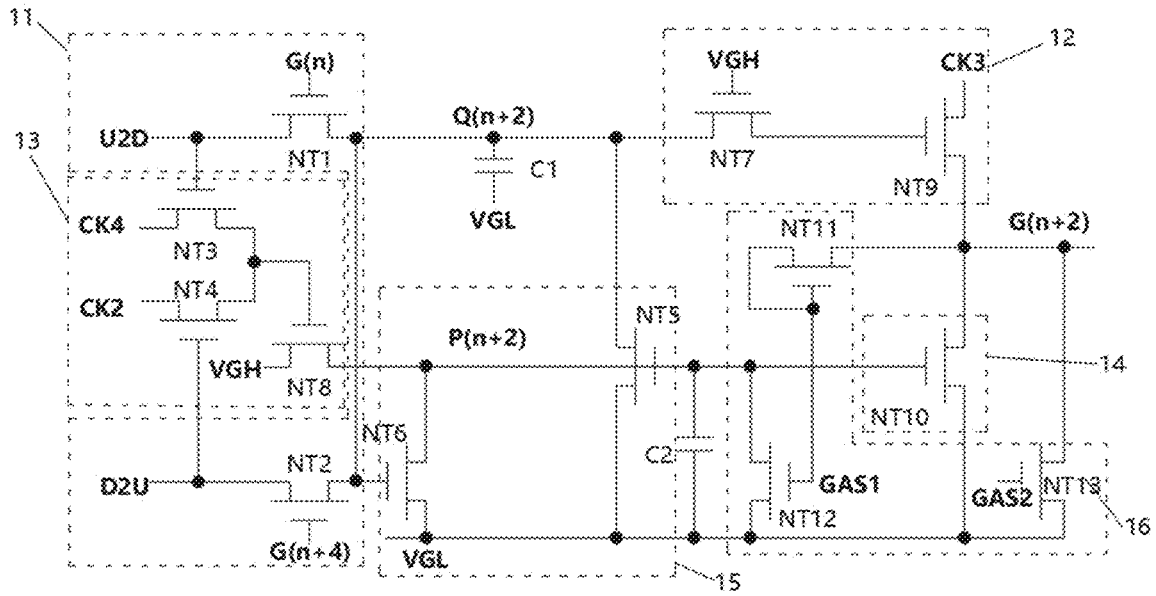
FIG. 4 is a diagram of another basic unit in the smallest repeating unit in the conventional GOA circuit.

A left-side GOA circuit and a right-side GOA circuit are placed on both sides of the display panel. In one example, the left-side GOA circuit drives the odd scan lines and the right-side GOA circuit drivers the even scan lines. When the display panel is a 4CK structure, the GOA circuit has multiple smallest repeating units, where each smallest repeating unit has two basic units. FIG. 3 is a diagram of a basic unit in the smallest repeating unit in the conventional GOA circuit. In other words, FIG. 3 is a diagram of the $n^{th}$-stage GOA unit. FIG. 4 is a diagram of another basic unit in the smallest repeating unit in the conventional GOA circuit. In other words, FIG. 4 is a diagram of the $(n+2)^{th}$-stage GOA unit. As shown in FIG. 3 and FIG. 4, the $n^{th}$-stage GOA unit and the $(n+2)^{th}$-stage GOA unit could constitute a GOA repeating unit. The GOA circuit has 4 clock signals CK: the first clock signal CK1 to the fourth clock signal CK4. When the $n^{th}$-stage clock signal of the $n^{th}$-stage GOA unit is the first clock signal CK1, the $(n+1)^{th}$-stage clock signal of the $n^{th}$-stage GOA unit is the second clock signal CK2 and the $(n-1)^{th}$-stage clock signal of the $n^{th}$-stage GOA unit is the fourth clock signal CK4. When the $n^{th}$-stage clock signal of the $(n+2)^{th}$-stage GOA unit is the third clock signal CK3, the $(n+1)^{th}$-stage clock signal of the $(n+2)^{th}$-stage GOA unit is the fourth clock signal CK4 and the $(n-1)^{th}$-stage clock signal of the $(n+2)^{th}$-stage GOA unit is the second clock signal CK2. It could be understood that when the pull-down control module 13 of the $n^{th}$-stage GOA unit receives the second and the fourth clock signals and the output pull-up module 12 of the $n^{th}$-stage GOA unit receives the first clock signal, the pull-down control module 13 of the $(n+1)^{th}$-stage GOA unit receives the first and the third clock signals and the output pull-up module 12 of the $(n+1)^{th}$-stage GOA unit receives the second clock signal. Surely, the display panel could be implemented with an 8CK structure and the GOA circuit has multiple smallest repeating units, where each smallest repeating unit has two basic units.

Figure 5:
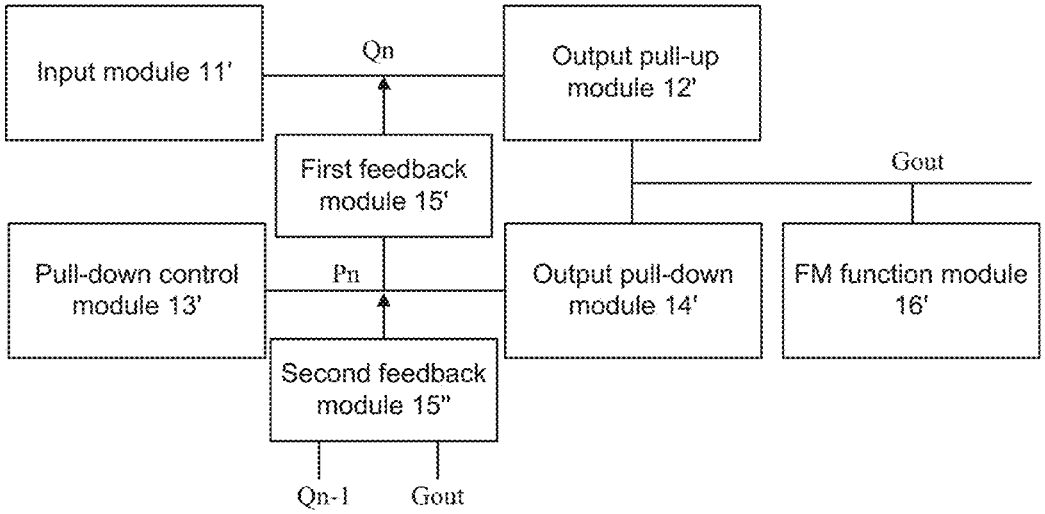
FIG. 5 is a functional block diagram of a GOA circuit according to an embodiment of the present invention.
Figure 6:
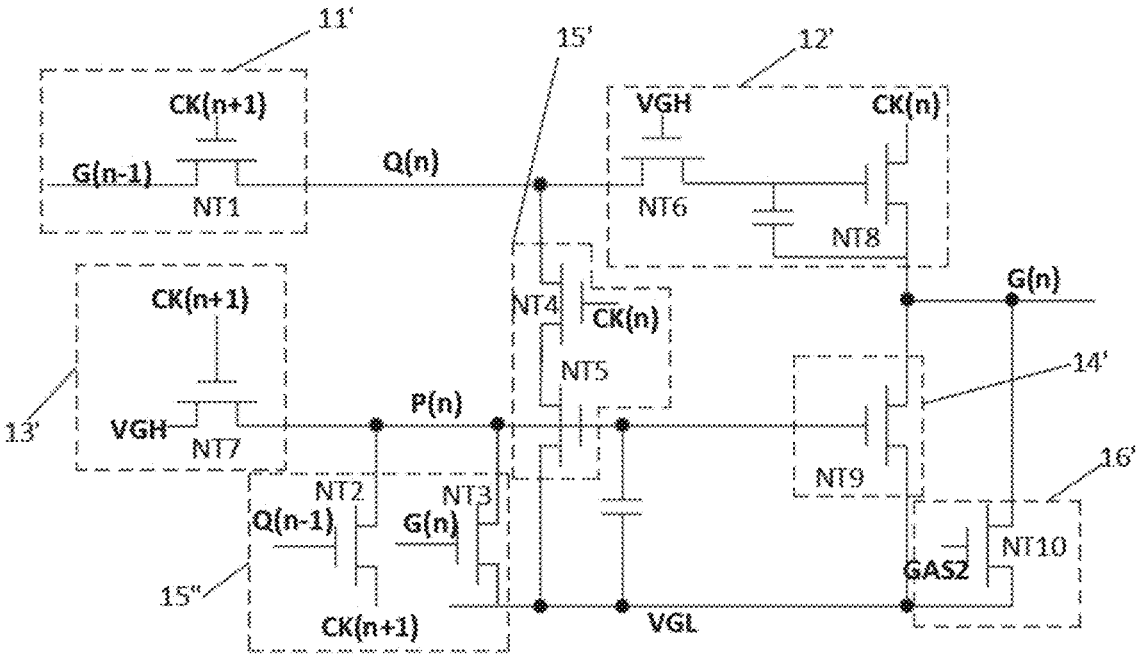
FIG. 6 is a diagram of a structure of a GOA circuit according to an embodiment of the present invention.

FIG. 5 is a functional block diagram of a GOA circuit according to an embodiment of the present invention. FIG. 6 is a diagram of a structure of a GOA circuit according to an embodiment of the present invention. As shown in FIG. 5 and FIG. 6, the $n^{th}$-stage GOA unit comprises: an input module 11', an output pull-up module 12', a pull-down control module 13', an output pull-down module 14', a first feedback module 15', a second feedback module 15", and an FM function module 16'. Here, m and n are both integers and $m \geq n \geq 1$.

The input module 11' is electrically connected to the clock signal CK(n+1) of the $(n+1)^{th}$-stage GOA unit, the gate driving signal G(n−1) of the $(n-1)^{th}$-stage GOA unit, and the first node Q(n) of the $n^{th}$-stage GOA unit. The input module 11' is configured to input a signal according to the clock signal CK(n+1) of the $(n+1)^{th}$-stage GOA unit and the gate driving signal G(n−1) of the $(n-1)^{th}$-stage GOA unit, and the first node Q(n) of the $n^{th}$-stage GOA unit. The input module 11' comprises a first TFT NT1. The gate of the first TFT NT1 receives the clock signal CK(n+1) of the $(n+1)^{th}$-stage GOA unit. The source of the first TFT NT1 receives the gate driving signal G(n−1) of the $(n-1)^{th}$-stage GOA unit. The drain of the first TFT NT1 is connected to the first node Q(n) of the $n^{th}$-stage GOA unit.

The output pull-up module 12' is electrically connected to the first node Q(n) of the $n^{th}$-stage GOA unit, the constant high voltage signal VGH and the clock signal CK(n) of the $n^{th}$-stage GOA unit. The output pull-up module 12' is configured to pull up the $n^{th}$-stage gate driving signal according to the clock signal CK(n) of the $n^{th}$-stage GOA unit. That is, the output pull-up module 12' pulls up the current-stage gate driving signal according to the clock signal CK(n) of the current-stage GOA unit. The output pull-up module 12' comprises a sixth TFT NT6 and an eighth TFT NT8. The gate of the sixth TFT NT6 receives the constant high voltage signal VGH. The source of the sixth TFT NT6 is connected to the first node Q(n) of the $n^{th}$-stage GOA unit. The drain of the sixth TFT NT6 is connected to the gate of the eighth TFT NT8. The source of the eighth TFT NT8 receives the clock signal CK(n) of the $n^{th}$-stage GOA unit.

The pull-down control module 13' is electrically connected to the constant high voltage signal VGH, the clock signal CK(n+1) of the $(n+1)^{th}$-stage GOA unit and the second node P(n) of the $n^{th}$-stage GOA unit. The pull-down control module 13' is configured to control the $n^{th}$-stage GOA unit to output a low-voltage-level gate driving signal G(n) in the non-working state according to the clock signal CK(n+1) of the $(n+1)^{th}$-stage GOA unit. The pull-down control module 13' comprises a seventh TFT NT7. The gate of the seventh TFT NT7 receives the clock signal CK(n+1) of the $(n+1)^{th}$-stage GOA unit. The source of the seventh TFT NT7 receives the constant high voltage signal VGH. The drain of the seventh TFT NT7 is connected to the second node P(n) of the $n^{th}$-stage GOA unit.

The output pull-down module 14' is electrically connected to the second node P(n) of the $n^{th}$-stage GOA unit and the constant low voltage signal VGL. The output pull-down module 14' is configured to pull down the gate driving signal G(n) of the $n^{th}$-stage GOA unit. The output pull-down module 14' comprises a ninth TFT NT9. The gate of the ninth TFT NT9 is connected to the second node P(n) of the $n^{th}$-stage GOA unit. The source of the ninth TFT NT9 receives the constant low voltage signal VGL.

The first feedback module 15' is electrically connected to the first node Q(n) of the $n^{th}$-stage GOA unit and the second node P(n) of the $n^{th}$-stage GOA unit, the clock signal CK(n) of the $n^{th}$-stage GOA unit and the constant low voltage signal VGL. The first feedback module 15' is configured to pull down the voltage level of the first node Q(n) of the $n^{th}$-stage GOA unit according to the signal of the second node P(n) of the $n^{th}$-stage GOA unit and the clock signal CK(n) of the $n^{th}$-stage GOA unit. The first feedback module 15' comprises a fourth TFT NT4 and a fifth TFT NT5. The gate of the fourth TFT NT4 receives the clock signal CK(n) of the $n^{th}$-stage GOA unit. The source of the fourth TFT NT4 is connected to the drain of the fifth TFT NT5. The drain of the fourth TFT NT4 is connected to the first node Q(n) of the $n^{th}$-stage GOA unit. The gate of the fifth TFT NT5 is connected to the second node P(n) of the $n^{th}$-stage GOA unit. The source of the fifth TFT NT5 receives the constant low voltage signal VGL.

The second feedback module 15" is electrically connected to the second node P(n) of the $n^{th}$-stage GOA unit, the first node Q(n−1) of the $(n-1)^{th}$-stage GOA unit, the clock signal CK(n+1) of the $(n+1)^{th}$-stage GOA unit, the gate driving signal G(n) of the $n^{th}$-stage GOA unit and the constant low voltage signal VGL. The second feedback module 15" is configured to pull down the voltage level of the second node P(n) of the $n^{th}$-stage GOA unit according to the signal of the first node Q(n−1) of the $(n-1)^{th}$-stage GOA unit, the clock signal CK(n+1) of the $(n+1)^{th}$-stage GOA unit and the gate driving signal G(n) of the $n^{th}$-stage GOA unit. The second feedback module 15" comprises a second TFT NT2 and a third TFT NT3. The gate of the second TFT NT2 is connected to the first node Q(n−1) of the $(n-1)^{th}$-stage GOA unit. The source of the second TFT NT2 receives the clock signal CK(n+1) of the $(n+1)^{th}$-stage GOA unit. The drain of the second TFT NT2 is connected to the second node P(n) of the $n^{th}$-stage GOA unit. The gate of the third TFT NT3 receives the gate driving signal G(n) of the $n^{th}$-stage GOA unit (the current-stage driving signal). The source of the third TFT NT3 receives the constant low voltage signal VGL. The drain of the third TFT NT3 is connected to the second node P(n) of the $n^{th}$-stage GOA unit.

The second feedback module 15" introduces the node Q of the previous stage and the output signal Gout of the current stage to control the node P of the current stage. This prevents the competition between the inner nodes P/Q and ensures the stability of the node P. The second feedback module 15" and the first feedback module 15' realize the one-way feedback from the node P to the node Q and reduce the feedback complexity between the inner nodes P/Q.

The FM function module 16' is electrically connected to the constant low voltage signal VGL and the global signal GAS2. The FM function module 16' is configured to control the gate driving signal G(n) of the $n^{th}$-stage GOA unit in the working state according to the global signal GAS2. The FM function module 16' comprises a tenth TFT NT10. The gate of the tenth TFT NT10 receives the global signal GAS2. The source of the tenth TFT NT10 receives the constant low voltage signal VGL.

Figure 7:
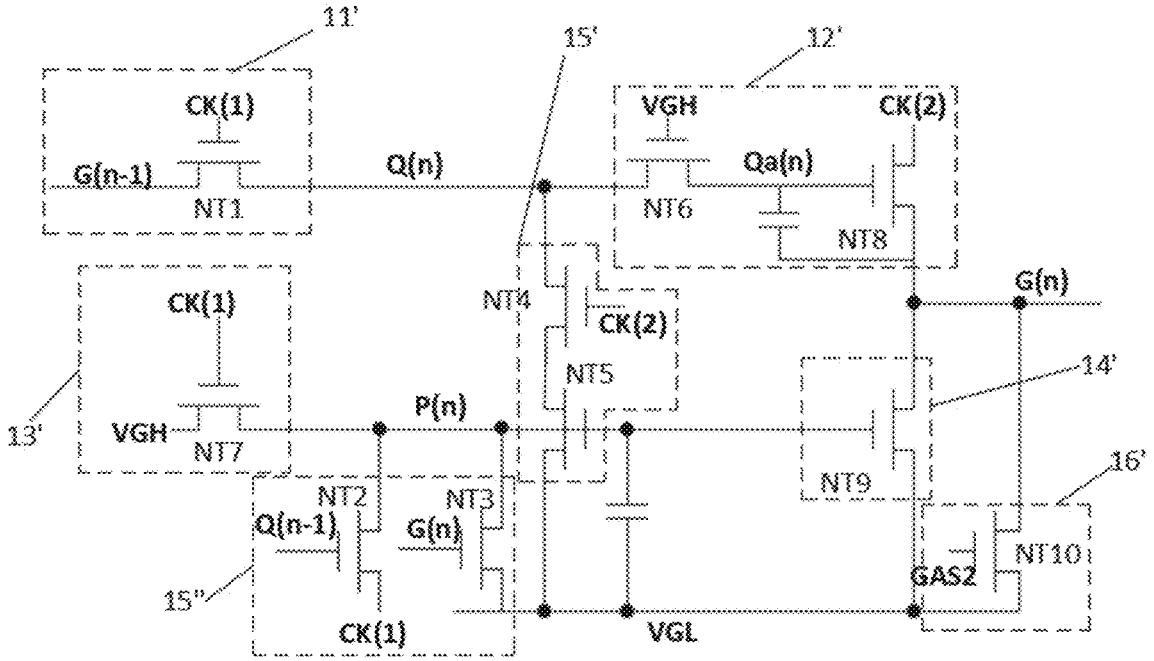
FIG. 7 is a diagram of a basic unit in the smallest repeating unit in the GOA circuit according to an embodiment of the present invention.
Figure 8:
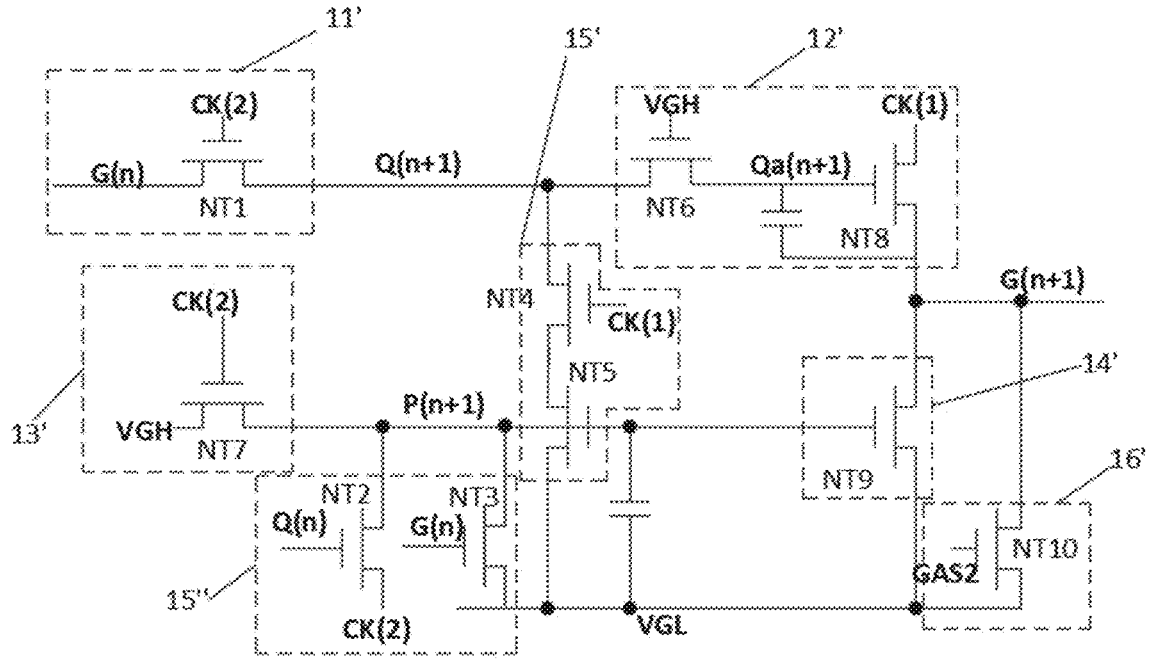
FIG. 8 is a diagram of another basic unit in the smallest repeating unit in the GOA circuit according to an embodiment of the present invention.
Figure 9:
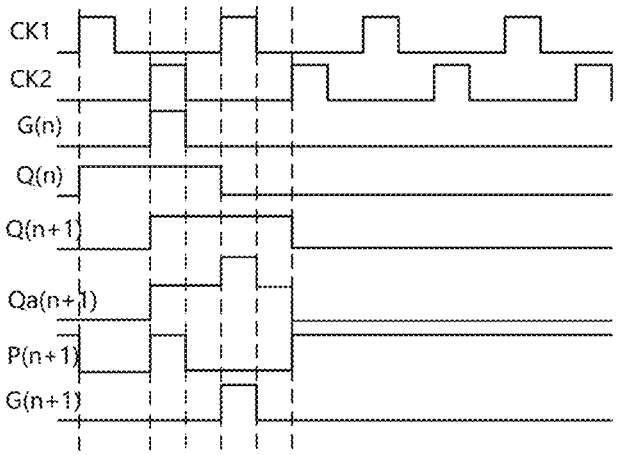
FIG. 9 is a driving timing diagram of the GOA circuit according to an embodiment of the present invention.

In this embodiment, the GOA circuit is implemented with multiple smallest repeating units, where each smallest repeating unit has two basic units. FIG. 7 is a diagram of a basic unit in the smallest repeating unit in the GOA circuit according to an embodiment of the present invention. In other words, FIG. 7 is a diagram of the $n^{th}$-stage GOA unit according to an embodiment of the present invention. FIG. 8 is a diagram of another basic unit in the smallest repeating unit in the GOA circuit according to an embodiment of the present invention. In other words, FIG. 8 is a diagram of the $(n+1)^{th}$-stage GOA unit according to an embodiment of the present invention. As shown in FIG. 7 and FIG. 8, the $n^{th}$-stage GOA unit and the $(n+1)^{th}$-stage GOA unit could constitute a GOA repeating unit. FIG. 9 is a driving timing diagram of the GOA circuit according to an embodiment of the present invention. Please refer to FIG. 7 and FIG. 8 in conjunction with FIG. 9. The GOA circuit has two clock signal CK: the first clock signal CK(1) and the second clock signal CK(2). When the $n^{th}$-stage clock signal of the $n^{th}$-stage GOA unit is the second clock signal CK(2), the $(n+1)^{th}$-stage clock signal of the $n^{th}$-stage GOA unit is the first clock signal CK(1). When the $(n+1)^{th}$-stage clock signal of the $n^{th}$-stage GOA unit is the first clock signal CK(1), the $(n+1)^{th}$-stage clock signal of the $(n+1)^{th}$-stage GOA unit is the second clock signal CK(2).

According to an embodiment of the present invention, a display panel is disclosed. The display panel comprises any one of the above-mentioned GOA circuits. The display panel could be, for example, an LCD panel.

According to an embodiment of the present invention, a display device is disclosed. The display device comprises the above-mentioned display panel.

The GOA circuit of an embodiment could be applied in the gate driving technology of a cell phone, display, and TV, or any advanced technology in LCD or OLED field.

The GOA circuit according to an embodiment of the present invention introduces the second feedback module. The second feedback module controls the node P of the current stage according to the output of the current stage and the node Q of the previous stage. This avoids the competition between inner nodes P/Q and raises the stability of the node P. Furthermore, the present invention changes the two-way feedback between the nodes P and Q of the conventional GOA circuit into a one-way feedback from the node P to the node Q. This reduces the feedback complexity between the nodes P and Q in the circuit and thus reduces the circuit complexity. The one-way feedback could achieve the linear design more easily, raise the circuit stability, and thus the GOA circuit could be integrated in the display panel more easily to achieve the design of placing the GOA circuit in the active area.

Above are embodiments of the present invention, which does not limit the scope of the present invention. Any modifications, equivalent replacements or improvements within the spirit and principles of the embodiment described above should be covered by the protected scope of the invention.

INDUSTRIAL APPLICABILITY

The GOA circuit according to an embodiment of the present invention introduces the second feedback module. The second feedback module controls the node P of the current stage according to the output of the current stage and the node Q of the previous stage. This avoids the competition between inner nodes P/Q and raises the stability of the node P. Furthermore, the present invention changes the two-way feedback between the nodes P and Q of the conventional GOA circuit into a one-way feedback from the node P to the node Q. This reduces the feedback complexity between the nodes P and Q in the circuit and thus reduces the circuit complexity. The one-way feedback could achieve the linear design more easily, raise the circuit stability, and thus the GOA circuit could be integrated in the display panel more easily to achieve the design of placing the GOA circuit in the active area.

What is claimed is:

1. A gate driver on array (GOA) circuit, comprising m cascaded GOA units, wherein an $n^{th}$-stage GOA unit comprises:

an input module, electrically connected to a clock signal of an $(n+1)^{th}$-stage GOA unit, a gate driving signal of an $(n-1)^{th}$-stage GOA unit, and a first node of the $n^{th}$-stage GOA unit;

an output pull-up module, electrically connected to the first node of the $n^{th}$-stage GOA unit, a constant high voltage signal and a clock signal of the $n^{th}$-stage GOA unit;

a pull-down control module, electrically connected to the constant high voltage signal, the clock signal of the $(n+1)^{th}$-stage GOA unit and a second node of the $n^{th}$-stage GOA unit;

an output pull-down module, electrically connected to the second node of the $n^{th}$-stage GOA unit and a constant low voltage signal;

a first feedback module, electrically connected to the first node and the second node of the $n^{th}$-stage GOA unit, the clock signal of the $n^{th}$-stage GOA unit and the constant low voltage signal;

a second feedback module, electrically connected to the second node of the $n^{th}$-stage GOA unit, a first node of the $(n-1)^{th}$-stage GOA unit, the clock signal of the $(n+1)^{th}$-stage GOA unit, a gate driving signal of the $n^{th}$-stage GOA unit and the constant low voltage signal; and a FM function module, electrically connected to the constant low voltage signal and a global signal, where m and n are both integers and $m \geq n \geq 1$.

2. The GOA circuit of claim 1, wherein the input module comprises a first thin film transistor (TFT), having a gate receiving the clock signal of the $(n+1)^{th}$-stage GOA unit, a source receiving the gate driving signal of the $(n-1)^{th}$-stage GOA unit, and a drain electrically connected to the first node of the $n^{th}$-stage GOA unit.

3. The GOA circuit of claim 1, wherein the second feedback module comprises:

a second TFT, having a gate electrically connected to the first node of the $(n-1)^{th}$-stage GOA unit, a source receiving the clock signal of the $(n+1)^{th}$-stage GOA unit, and a drain electrically connected to the second node of the $n^{th}$-stage GOA unit; and a third TFT, having a gate receiving the gate driving signal of the $n^{th}$-stage GOA unit, a source receiving the constant low voltage signal, and a drain electrically connected to the second node of the $n^{th}$-stage GOA unit.

4. The GOA circuit of claim 1, wherein the first feedback module comprises:

a fourth TFT, having a gate receiving the clock signal of the $n^{th}$-stage GOA unit, a source, and a drain electrically connected to the first node of the $n^{th}$-stage GOA unit; and a fifth TFT, having a gate electrically connected to second node of the $n^{th}$-stage GOA unit, a source receiving the constant low voltage signal, and a drain electrically connected to the source of the fourth TFT.

5. The GOA circuit of claim 1, wherein the output pull-up module comprises:

a sixth TFT, having a gate receiving the constant high voltage signal, a source electrically connected to the first node of the $n^{th}$-stage GOA unit, and a drain; and an eighth TFT, having a gate electrically connected to the drain of the sixth TFT and a source receiving the clock signal of the $n^{th}$-stage GOA unit.

6. The GOA circuit of claim 1, wherein the pull-down control module comprises:

a seventh TFT, having a gate receiving the clock signal of the $(n+1)^{th}$-stage GOA unit, a source receiving the constant low voltage signal, and a drain electrically connected to the second node of the $n^{th}$-stage GOA unit.

7. The GOA circuit of claim 1, wherein the output pull-down module comprises:

a ninth TFT, having a gate electrically connected to the second node of the $n^{th}$-stage GOA unit, and a source receiving the constant low voltage signal.

8. The GOA circuit of claim 1, wherein the FM function module comprises:

a tenth TFT, having a gate receiving the global signal, and a source receiving the constant low voltage signal.

9. A display panel, comprising a gate driver on array (GOA) circuit, the GOA circuit comprising m cascaded GOA units, wherein an $n^{th}$-stage GOA unit comprises:

an input module, electrically connected to a clock signal of an $(n+1)^{th}$-stage GOA unit, a gate driving signal of an $(n-1)^{th}$-stage GOA unit, and a first node of the $n^{th}$-stage GOA unit;

an output pull-up module, electrically connected to the first node of the $n^{th}$-stage GOA unit, a constant high voltage signal and a clock signal of the $n^{th}$-stage GOA unit;

a pull-down control module, electrically connected to the constant high voltage signal, the clock signal of the $(n+1)^{th}$-stage GOA unit and a second node of the $n^{th}$-stage GOA unit;

an output pull-down module, electrically connected to the second node of the $n^{th}$-stage GOA unit and a constant low voltage signal;

a first feedback module, electrically connected to the first node and the second node of the $n^{th}$-stage GOA unit, the clock signal of the $n^{th}$-stage GOA unit and the constant low voltage signal;

a second feedback module, electrically connected to the second node of the $n^{th}$-stage GOA unit, a first node of the $(n-1)^{th}$-stage GOA unit, the clock signal of the $(n+1)^{th}$-stage GOA unit, a gate driving signal of the $n^{th}$-stage GOA unit and the constant low voltage signal; and a FM function module, electrically connected to the constant low voltage signal and a global signal, where m and n are both integers and $m \geq n \geq 1$.

10. A display device comprising a display panel that comprises a gate driver on array (GOA) circuit, the GOA circuit comprising m cascaded GOA units, wherein an $n^{th}$-stage GOA unit comprises:

an input module, electrically connected to a clock signal of an $(n+1)^{th}$-stage GOA unit, a gate driving signal of an $(n-1)^{th}$-stage GOA unit, and a first node of the $n^{th}$-stage GOA unit;

an output pull-up module, electrically connected to the first node of the $n^{th}$-stage GOA unit, a constant high voltage signal and a clock signal of the $n^{th}$-stage GOA unit;

a pull-down control module, electrically connected to the constant high voltage signal, the clock signal of the $(n+1)^{th}$-stage GOA unit and a second node of the $n^{th}$-stage GOA unit;

an output pull-down module, electrically connected to the second node of the $n^{th}$-stage GOA unit and a constant low voltage signal;

a first feedback module, electrically connected to the first node and the second node of the $n^{th}$-stage GOA unit, the clock signal of the $n^{th}$-stage GOA unit and the constant low voltage signal;

a second feedback module, electrically connected to the second node of the $n^{th}$-stage GOA unit, a first node of the $(n-1)^{th}$-stage GOA unit, the clock signal of the $(n+1)^{th}$-stage GOA unit, a gate driving signal of the $n^{th}$-stage GOA unit and the constant low voltage signal; and a FM function module, electrically connected to the constant low voltage signal and a global signal, where m and n are both integers and $m \geq n \geq 1$.

* * * * *